United States Patent [19]

Schwemmer et al.

[11] Patent Number: 4,893,485

[45] Date of Patent: Jan. 16, 1990

[54] APPARATUS FOR THE CONTINUOUS APPLICATION OF TREATING LIQUOR ON AN ABSORPTIVE, COMPRESSIBLE MATERIAL WEB

[75] Inventors: Martin Schwemmer, Urdorf; Albert Goetz, Limmat, both of Switzerland

[73] Assignee: Triatex International AG, Switzerland

[21] Appl. No.: 307,407

[22] Filed: Feb. 7, 1989

Related U.S. Application Data

[62] Division of Ser. No. 181,831, Apr. 15, 1988, Pat. No. 4,845,791.

[30] Foreign Application Priority Data

Apr. 16, 1987 [EP] European Pat. Off. ..... 87810240.9

[51] Int. Cl.[4] ..... D06B 23/00; D06B 15/02

[52] U.S. Cl. ..... 68/13 R; 68/21; 68/22 R; 118/60; 118/117; 118/665; 118/672

[58] Field of Search ..... 8/158; 68/13 R, 22 R, 68/21; 118/60, 117, 665, 672; 162/DIG. 6, DIG. 11; 28/183

[56] References Cited

U.S. PATENT DOCUMENTS

| | | | |
|---|---|---|---|
| 2,793,345 | 5/1957 | Hags | 118/672 X |
| 2,795,839 | 6/1957 | Seawell | 28/183 X |
| 2,922,475 | 1/1960 | Alexander | 162/DIG. 11 |
| 3,207,125 | 9/1965 | Strandberg, Jr. | 118/117 X |
| 3,521,600 | 7/1970 | Toya | 118/665 |
| 3,811,834 | 5/1974 | Schwemmer et al. | 8/158 X |
| 4,087,568 | 5/1978 | Fay et al. | 118/672 X |

OTHER PUBLICATIONS

"Controlling Glue Coating Thickness" from *Measurement and Control*, vol. 6, (Feb. 1973), p. 52.

*Primary Examiner*—Philip R. Coe

*Attorney, Agent, or Firm*—Ostrolenk, Faber, Gerb & Soffen

[57] ABSTRACT

A process and an apparatus for the continuous and controlled application of liquor on an absorptive, compressible material web such as textile webs, warp yarn layers or vleeces. One or more liquors are applied in amounts being comprised between the values of water retention capacity and saturation. The liquor containing web is passed through an equalizing device wherein the web is drawn through an equalizing nip or slit whose thickness is adjustable and smaller than the thickness of the incoming, liquor containing material web. The equalizing may be effected in the nip of two rollers. The liquor concentration in the web before and after the equalizing is statistically the same.

12 Claims, 1 Drawing Sheet

APPARATUS FOR THE CONTINUOUS APPLICATION OF TREATING LIQUOR ON AN ABSORPTIVE, COMPRESSIBLE MATERIAL WEB

BACKGROUND OF THE INVENTION

This invention belongs to the field of the treatment of flat, absorptive, compressible web materials with liquids such as treating liquor or finishing baths. In particular, the invention relates to a method for the continuous application of liquors, especially finishing liquors, on absorptive and compressible material webs, in particular fibrous webs such as textile webs, which are made to advance in a continuous and uniform manner from a supply, e.g. a spool, to a winding-on device or equivalent.

This invention is also related to apparatuses for carrying out the method.

The following description makes reference to the general case where advancing textile fiber webs are concerned. However, other absorptive, compressible webs may be substituted therefor such as certain papers, spongeous materials, synthetic and natural fiber vleeces, etc to which this invention also applies.

The instant invention refers to a method wherein such amounts of liquor are applied in one or several steps that the maximum amount of liquor which the web can take up by absorption, called the absorptivity limit, is not reached but where those amounts are greater than the water retention value of the web. The water retention value is a physical property of the web and may be determined by the DIN standard no. 53'814 (ASTM-D2402-65T). Processes where the absorptivity limit is reached and the liquor excess is removed afterwards, thus in particular the pad mangle methods, are outside the scope of this invention.

Quite a number of methods and working techniques are known in the textile processing art which are used to apply liquors of treating bathes to textile fiber webs. The term "web" comprises, in a known manner, a textile substrate which may absorb liquids, whose length is very great compared to its width, e.g. by about 500 to 10,000 times, and whose thickness is comprised between one and about ten times the diameter of the constituting fiber. This term "web" therefore comprises, besides the woven fabrics, also knitted fabrics and other non-woven webs such as vleeces. It further comprises rows or layers of parallel warp yarns which are to be sized, bleached or dyed before weaving. In these cases, the overall thickness of the web may even be greater. Examples of such techniques are the padding, the kiss roller application, the different methods of impregnation, the spraying, the application of liquors with sponges, the application of foamed liquors and the printing. In many cases, it is necessary or appropriate to apply first an excess of liquor and to remove that excess afterwards. An important example of the latter method is the pad mangle where the textile web is offered as much liquor as it may take up, and any excess is removed between squeeze rollers. It is not possible to remove any liquor in excess over the above-mentioned water retention value. Using technically reasonable squeezing pressures, the amount of liquor remaining in the web after squeezing is higher than that value. Without squeezing, the applied amount of liquor called "pickup" cannot be metered or controlled.

An important process for the application of liquors, especially of treating liquors, on textile webs is a method introduced in the '70s and called "MA process" (MA stands for minimum application) which brings about a uniform, controlled impregnation without local or overall excess application of liquors on textile material webs under high working speeds. It is disclosed, for example, as well as a preferred apparatus for its implementing, in U.S. patent specification nos. 3,862,553 and 3,822,834. It does not comprise any squeezing device. The minimum application amount is defined as that liquor amount in % by weight which is in the range between zero and a value given by the expression $(W^2/150)+40$ wherein W is the above defined water retention value. The upper limit of the amount of applied liquor, defined by the above-indicated expression, is situated at about 10 to 30% by weight of the limit of the squeezable excess. The process has found worldwide application and introduction, it is well known to the people skilled in the art, and it is deemed unnecessary to mention its advantages herein.

Although the process just mentioned has been known as a "minimum application" method, it may also be used to apply greater amounts of liquors in a metered, controlled and uniform manner. This alternative and generalized technique is named in the following as "metering roller application" and comprises the minimum application as well. This metering roller application technique therefore comprises all applications resulting in applied amounts between the value of W and the saturation value (absorption limit) of the substrate.

The application of about 10 to 25 % by weight of preferably aqueous liquors on dry hydrophilic textile webs, i.e. webs containing not more than about 15% by weight of natural or residual humidity, is easy in that a uniform one-side application will be homogeneously spread and distributed throughout the textile material due to capillary forces. However, it may happen even in the minimum application method that particularly weakly fiber affine and viscous liquors will give an uneven or undesirably one-sided application result.

In the case of greater application quantities, the time duration available for the homogeneous distribution of the applied liquor in the material web which is given by the dwell time of the web between the applicator device and the drying means, will sometimes not be sufficient so that inhomogenities are observed. Similar phenomena occur when the web to be loaded with a liquor already contains another one; in this case, the uneven liquor distribution is even more significant since the liquor distribution within the web material is based here essentially on liquid-liquid diffusion, a process which is significantly slower than a distribution by capillarity.

A uniform liquor or bath distribution in the cases just discussed has been achieved until now by dwelling techniques where the web is wound up and abandoned for a longer time. Dwelling techniques, however, are material, space and capital consuming.

Another approach to achieve a uniform liquor distribution are the pad mangle techniques which do not, however, belong to the instant field of invention. Further advantages of this approach, besides the already mentioned limitation in application control, are expensive machinery, technically complicated operation and the fact that, when webs already containing a liquor are used, this liquor is partially squeezed out together with the impregnation second liquor.

It has already been suggested to pass a sizing liquor containing web formed by rows of parallel and horizontal warp yarns through a squeezing device having squeezing rollers. It is not known whether an equalizing of the sizing liquor may be obtained; anyway the mere squeezing is an uncontrolled operation, and generally part of the sizing liquor is squeezed out of the warp yarns which is not desired.

Swiss patent specification no. 530,230 casually mentions that the uniform impregnation of a textile material by a finishing liquor may be enhanced at particularly adverse conditions by special measures such a mechanical means. However, this reference exclusively deals which the minimum application defined above where, in detrimental cases of the liquor distribution, the use of squeezing means may accelerate this distribution. Experiments have nevertheless shown that the uniformity of distribution is a feature characteristic for the minimum application, and thus the use of squeezing means could not give a model to cases where there is a squeezable liquor excess in the web material.

Squeezing devices are composed of at least one pair of cooperating rollers; at leas one roller of the pair is provided with a rubber elastic surface or is totally made from rubber. The material web is passed between the rollers and pinched by them. A squeezing effect is obtained in that the two rollers are pressed against each other, the elastic surface of the rubber roller flattens in the contact region, and exerts a squeezing action. An adjustment of the squeezing effect is, as in the pad mangle, only possible in very narrow limits. It has been found that such a squeezing device is not fitted for the invention and cannot be used.

SUMMARY OF THE INVENTION

There is a first and major object of this invention to eliminate the problems and drawbacks of uneven distribution of squeezable amounts of liquors in absorptive material webs and to provide a method for an even, homogeneous distribution of such liquors in compressible material webs.

A further object of the invention is to provide such a method which is a continuous one and can be integrated without difficulty into a general process line for the application of liquors, particularly finishing liquors, on absorptive and compressible material webs.

Still another object is to provide an equalizing method of the depicted kind which allows to adjust, to control and to maintain constant the equalizing effect on which the method is based.

A further object of this invention is to provide an equalizing method as outlined above where the equalizing effect can easily be monitored without a permanent, overall squeezing out of liquor from the liquor carrying absorptive material web.

Another objects of the invention are apparatuses permitting the performance of the above defined processes in a simple, inexpensive way, allowing perfect control and monitoring of the equalizing effects.

Now, the above detailed objects and still others are implemented by the process of the invention which comprises the passage of the liquor loaden material web through an equalizing device wherein the said material web is temporarily and continuously compressed, as it advances through the device, to a predetermined, adjustable thickness which is smaller than the thickness of the material web before it enters the equalizing device. The compression is effected in such a manner that there is no liquor added to or removed from the material web in the equalizing zone, only a liquor equalizing effect being obtained within the material web. Therefore, the amount of liquor in the material web remains substantially the same upstream and downstream the equalizing device.

It has been found that the liquor within the material web can effectively be equalized to give a perfectly homogeneous distribution therein, when the liquor containing material web is compressed by a determined amount, referred to the condition before compression, that the amount of compression is in the first place a function of the liquor content of the web but also of its structure, and that the amount of compression must therefore be adjustable to adapt it to the actual conditions. It will be evident that these basic findings could not be derived from the condition of squeezing a web using unqualified, high pressures and not using a compression nip or slit.

The effect of the depicted adjustable compression is to merely redistribute the liquor within the material web, in establishing a contact of regions of the web which contain relatively high amounts of liquor, with those containing relatively low liquor amounts, without squeezing liquor out of the web.

The invention provides a novel, unique and universal conception bringing about a rapid, unform and controllable impregnation of material webs with liquor and which can be combined with any application method where the uniformity of distribution should be improved. The new method is particularly advantageous in spraying methods which are elegant but do not give a uniform liquor distribution. A preferred use of the method is together with the metering roller application process. The material web is compressed in the equalizing device by passing it through a slit or a nip whose thickness is comprised between zero and the thickness of the web before entering the slit or nip. The adjustment of the nip depends upon several factors, the purpose being the mere redistribution, i.e. equalization, of liquor in the interior of the material web. The most important factors are the compressibility of the liquor containing web, its thickness, and its liquor content. Further factors are the physical properties of liquor and material web and the degree of irregularity of the applied liquor.

In practice, it is not necessary to known all these factors. It is before all necessary to operate the equalizing device in such a manner that there is no overall squeezing out of liquor at the equalizing nip. A short-lasting appearance of squeezed liquor is normal since a local liquor excess belongs to the nature of irregular application. This short-lasting appearance of squeezed liquor may advantageously be used to control and adjust the thickness of the nip as it will be described later.

Generally, it is necessary to determine the liquor amount per unit area or weight of the material web upstream the equalizing device and to compare it with predetermined values in order to obtain and to keep constant the desired amount of liquor in the material web. For gross results, one measuring position will be sufficient, namely between liquor application device and equalizing device. In this case, the basic weight of the raw material web before impregnation must be known and input. Better results are obtained when the data of the raw web are continuously measured too. Furthermore, the basic weight of the material web after equalizing may be measured to supply a control value for adjusting the equalizing device. This is to be explained later.

The measuring of the above mentioned data is known per se and may be realized by radiation or wave absorption.

In the process of the invention, the material web to be impregnated is first introduced, as usual, into a feeding device. Such devices either comprises two rollers forming a small nip through which the material web is passed, at least one of the rollers being positively driven, or comprise a single driven roller having an anti-skid surface, which is contacted by the web over an angle of at least 180°. The web is then led either directly or over guide, compensating and/or spreading rollers to the liquor application device.

The preferred application device which may also be provided twice or more times, i.e. the metering roller applicator is either the one known from U.S. Pat. No. 3,862,553, the MA applicator, or a new development made by the applicant and disclosed in U.S. Pat. No. 4,672,705. The construction of the devices and their function is in detail disclosed in these patents which are therefore incorporated herein by reference.

The process of the invention may also be realized together with other application devices, known to the man skilled in the art. Pad mangling where an excess of liquor is squeezed out of a web is not suitable. The selected application method may provide an irregular application. However, constant lengthwise or transverse strips as irregularities are to be avoided.

The slit or nip of the equalizing device may be realized in different manners. Generally, a nip is formed between two rollers, one of them having preferably a rubber elastic surface or being fully made from rubber. This roller will be driven. The other roller should have a harder surface and may also be driven.

For the adjustment of the roller nip, one roller is approached to the other. This motion may be best effected by a screw spindle actuator. It is preferred to provide additional means in order to retract rapidly one roller from the other in order to avoid web breakage on the appearance of sewed seams or other thickened portions. This rapid release may be effected by a hydraulically actioned toggle lever mechanism. The man in the art is aware of suitable solutions.

It is appropriate to equip the hard surface roller with means for heating for cooling. Means may be provided to steam the web from the outside in order to avoid liquor evaporation when the roller is heated.

The slit may also be formed between solid surfaces facing one another with a short distance and preferably provided with an elastic surface layer having a low frictional coefficient.

More than one equalizing devices may be provided in succession. When rollers are used for equalizing, they may be mounted in any arrangement whatsoever; however, their axes must be parallel. The common plane of the two axes may thus be horizontal, vertical or at any angle. The web may further contact one or both rollers at any desired angle.

After leaving the equalizing device, the material web will be processed as usual, generally it will be dried in a continuously operated dryer, in particular a tenter frame which is equipped with the conventional auxiliary devices. Finally, the web will be wound on a roll.

The invention now allows to eliminate irregularities of liquor distribution which are often observed in the use of known application techniques and which had until now to be accepted or circumvented by the use of other, complex application or impregnation methods. Furthermore, it is now possible to apply successively two or more different liquors which are not compatible in mixture and which can now be mixed and uniformly distributed in the web material itself. The invention allows to obtain a controlled and metered liquor application being constant independently on the web travelling speed.

BRIEF DESCRIPTION OF THE DRAWINGS

The present invention will now become more fully understood from the detailed description of preferred embodiments thereof, given hereinbelow, and the accompanying drawings which are given for illustration purposes only and thus are not limitative of the invention.

In the drawings, all FIGURES are partly sectioned, schematical side elevations of the apparatuses of the invention.

All figures are schematical representations only for showing roughly the web travel path. Same reference numerals refer to identical or functionally equivalent elements. The process of the invention will be understood from the drawings and the following description.

DESCRIPTION OF PREFERRED EMBODIMENTS

Figure 1:
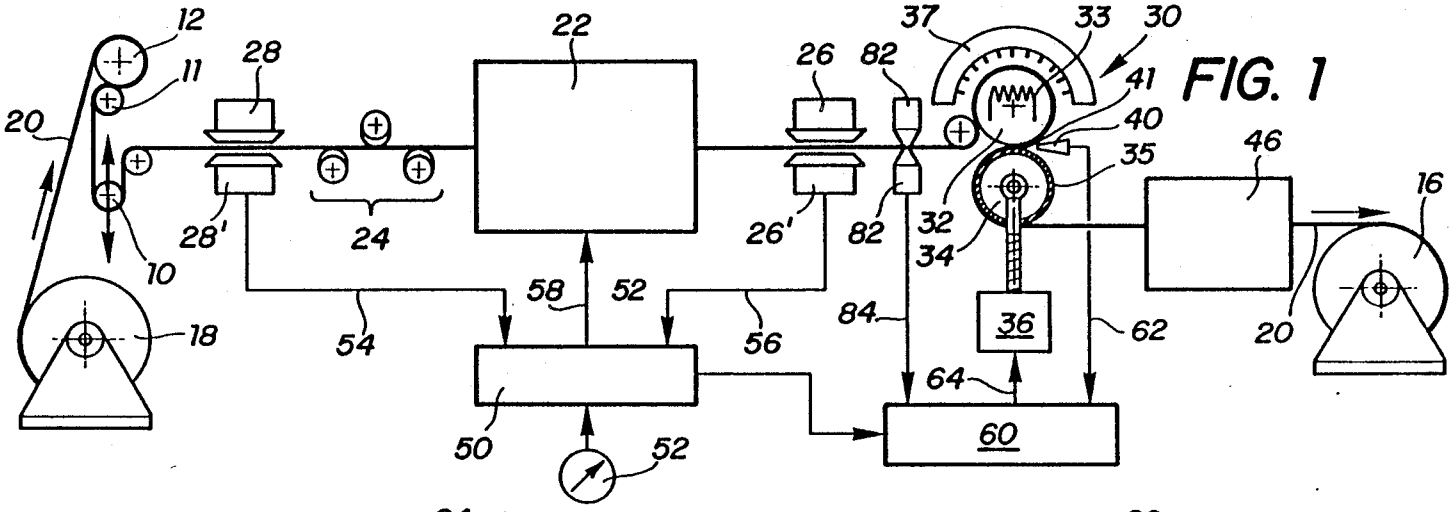
FIG. 1 shows a general embodiment of the device.

A preferred embodiment of the apparatus of the invention is schematically shown in FIG. 1. Auxiliary devices such as circulation or feeder pumps, liquor containers, machine frames and supports, motors, control and metering units, computers etc. are not shown; they are known to the people skilled in the art.

The apparatus is first equipped with a web feeding device represented by the roller 12. The incoming material web 20, unwound from a roll 18, contacts the driven feeder roller 12 which has an anti-skid surface, by about 270°. It is .then fed to the web tension compensator over a deflection roller 11. The web tension is controlled by the up-and-down motion of a compensating roller 10. The web then passes through the contact-free measuring unit 28, 28' which measures the thickness, the basic weight and the humidity content of the web, and it goes then through the arcuated rollers system 24 where the web is smoothed and winkles are stretched out. The system 24 is normally necessary for knitted fabrics and may be foregone with stronger fabrics such as shirt fabrics.

The material web is then fed into an applicator device 22 which may be constructed as desired and which effects a more or less uniform, controlled, metered liquor application whose amount is comprised between the value of the water retention capacity of the substrate, determined according ASTM-D2402-65T corresponding to German standard DIN 53'814 and Swiss standard SNV 98'592, and the saturation value. The applicator device may be a roller, foam or spray application device.

The unit 22 may also be provided twice or more times when is suitable or necessary to apply partial liquors, e.g. in reactive dyeing.

The web now traverses another basic weight measuring unit 26, 26' which determines, in cooperation with the unit 28, 28', the amount of liquor applied.

The web then enters the equalizing device 30 which comprises two rollers 32 and 34 of the same diameter which are driven with the same superficial speed than the travelling speed of the web 20. The axes of the rollers lie in a vertical plane. The upper roller 32 is stationary whereas the lower roller 34 having a rubber surface coating, may be raised and lowered by the pneumatic, hydraulic or electric motor 36. The two rollers may also be interchanged.

A liquor sensor 40 is provided within the free space in front of the nip 41 of the rollers 32, 34 and laterally from the web 20. The sensor is designed to detect liquor portions which may be temporarily squeezed out of the web and which will be present as tiny bulbs. The liquor sensor 40 may be constructed in any known manner. It may, for example, sense the liquid level by surface contact, or it may operate based on electrical, magneto-electrical (Hall effect) or reflectory parameters such as light from an infrared or a laser source, other radiations such as beta or gamma radiations, soft X-rays, corpuscular radiation, etc. The sensor 40 is preferably adapted to sense or scan periodically over the width of the web 20, for example with a scanning frequency of some Hertz. It is only essential that the sensor 40 supplies a signal representative of a true information about the presence or absence of liquor at any location in front of the roller nip 41.

The web 20 now is conducted into the drier 46 and is finally wound up on the roll 16.

Instead of a real, physical material web 20, rows of parallel yarns forming one or more horizontal layers, for example warp yarn layers, may also be used and treated.

The device comprises furthermore control and metering means to reach the purpose of the invention. In the applicator control unit 50 having the regulator 52, the liquor amount to be applied by the applicator unit 22 is adjusted and maintained constant. The necessary information about the basic weight of the material web is supplied over the conductor lines 54 and 56 from the basic weight measuring units 28, 28' and 26, 26'. These units are well known in the art and generally operate on the basis of radiation absorption. Corresponding control orders are transmitted over the line 58 to the applicator unit 22.

The liquor detector 40 supplies a measuring signal over the line 62 to the equalizer control unit 60 which transmits a control order over the line 64 to the motor 34 for the roller adjustment. The control units 50 and 60 may be connected to each other.

The roller 32 may be equipped with heating or cooling means; this is indicated by the coil 33. Furthermore, a steam hood 37 may be provided for introducing water steam into the space above and around the roller 32.

The raising-and-lowering motor 36 is arranged in such a manner that it can raise the roller 36 until a nip 41 having a defined thickness, is formed with the roller 32. Furthermore, a possibility (not shown) is foreseen to lower the roller 34 very rapidly by about 5 to 15 mm. This will be necessary when the additional thickness sensor 82—which may also be a contact-free one—detects a thicker spot or zone in the web 20. The thickness sensor 82 is connected by the line 34 to the control unit 60. The thicker spot in the web is then able to pass the equalizing device when the roller 34 has been lowered by that amount.

Figure 2:
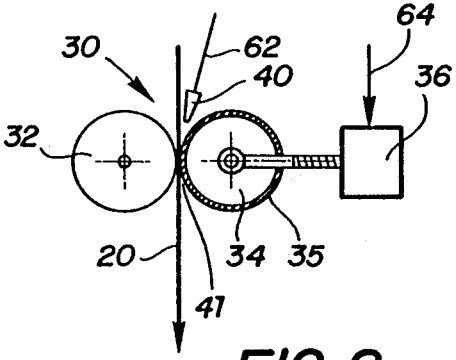
FIG. 2 is a variant of the device shown in FIG. 1.

FIG. 2 shows in a very schematical manner a side elevation of another embodiment of the equalizing device. The two equalizing rollers 32 and 34, the latter being coated by a rubber layer 35, have their axes in a horizontal plane. The control motor 36 adjusts the thickness of the nip 41 by a horizontal displacement of the roller 34 so that no measures will be necessary to neutralize the weight of this roller.

Figure 3:
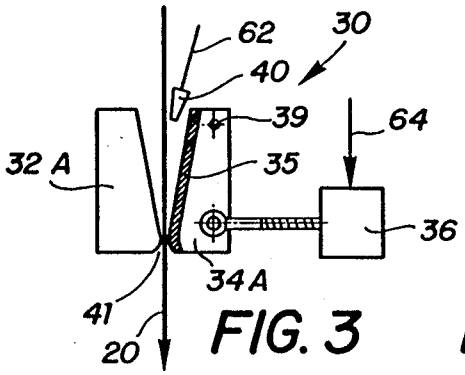
FIG. 3 shows another embodiment of the equalizing device of FIG. 1.

Finally, FIG. 3 shows, also schematically, an embodiment of a roller-free equalizing slit. The slit is formed between an elongated stationary shaped part 32A and another shaped part 34A which is, however, pivotable around the axis 39. The operating surface of the shaped part 34A coming into contact with the material web 20, is coated with a rubber layer. All surfaces coming into contact with the web 20 are finally coated with an anti-frictional layer. The equalizing slit is formed in the lower portion of the shaped parts 32A, 34A. For the control device 36, see the description above.

Figure 4:
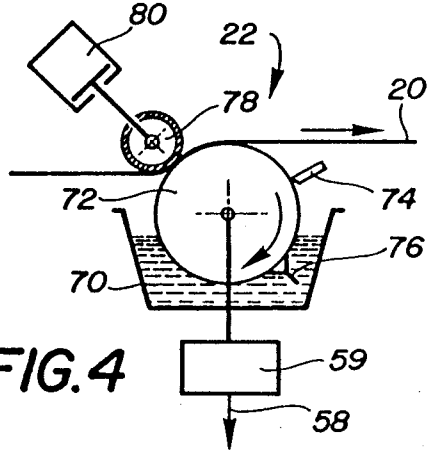
FIG. 4 represents an embodiment of a portion of the device of FIG. 1 showing a metering roller applicator system.

FIG. 4 shows schematically in side elevation a preferred applicator unit 22, namely the already mentioned metering roller application device.

The metering roller application device used here is another invention of the applicants and disclosed in all details in U.S. Pat. No. 4,672,705 incorporated herein by reference. Thus, the description of this apparatus need not fully be repeated.

A metering roller 72 is journalled for rotation in a trough 70 partially filled with liquor. The roller 72 is rotated in the direction indicated by the arrow. The material web 20 is slidingly passed over the upper surface of the metering roller 72; generally, the travelling speed of the web 20 is greater than the superficial speed of the metering roller 72.

Above the metering roller 72, a lowerable, drivable counter-roller 78 is provided which is directed to the arc of the roller 72 situated about 10 to 30 degrees from its summit, seen against the direction of web travel. This counter-roller, named tangential roller, is coated with rubber and can be adjusted by the motor 80 against and from the surface of the metering roller 72. Its purpose is to transfer the web 20 in supported condition onto the surface of the metering roller. The ductor blades 74 and 76 will keep the metering roller clean.

The motor 59 for a constant but adjustable rotational motion of the metering roller 72 whose superficial speed determines the amount of liquor to be applied in unit time, is connected by the line 58 to the control unit 50.

The system works in the following way:

The liquor amount applied to the web 20 is continuously monitored as a function of the difference of the data measured by the basic weight measuring units 28, 28' and 26, 26'. Suitable, known constructions of these units will allow a continuously averaging of the measured values over the width of the web in order to compensate for irregularities. Should the actual value of the application differ from the reference value set by the regulator 52, the control unit will correct the liquor applicator.

The material web 20 now containing the liquor, is guided around the upper roller 32 of the equalizing device through the nip 41 with the lower equalizing roller 34 and around the latter. The web then enters a drier 46, e.g. a tenter frame, and is finally wound on a roll 16.

The thickness of the roller nip 41 is adjusted by the control motor 36 to the predetermined value for the respective substrate and the amount of liquor therein, this value being determined by tests or experience and stored in a memory of the control device 60. This control device 60 will then have the thickness of the equalizing nip gradually reduced until first portions of liquor, squeezed out of the web by the continuously growing compression in the nip, will appear in front of the nip 41 and will not disappear immediately. This condition is detected by the liquid sensor 40 and transmitted to the control device 60 which will order the thickness of the nip 41 to be slightly increased. The short-lasting appearing and disappearing of emerging liquor portions indicate the optimum operation of the equalizing.

If no liquor portions will emerge in front of the nip 41, the liquor amount applied in the device 22 is too low to form a squeezable excess. This condition will be known before or transmitted by the application control unit 50 to the control device 60. In this case, motor 36 will receive an order to adjust the thickness of the nip 41 to an invariable value which is programmed and will be, e.g., 60% or 80% of the thickness of the material web.

For such applications, few tests will give empirically the optimum thickness of the nip.

Should viscous liquors be equalized or such liquors which do not have a good affinity t the substrate, a heating will be beneficial. For this reason the roller 32 is equipped with a heater. In order to prevent the evaporation of liquor solvent, the hood 37 allows to blow steam or a steam-air mixture onto the material web.

The apparatus and also the method of this invention may be modified in the frame defined by the claims. For example, the motor 36 which determines the position of the lower roller 34 of the equalizing device, may act on a reducing gear in order to obtain a still finer adjustment. Also, a dwell path may be provided between the applicator device 22 and the equalizing device 30.

The material of the rollers of the equalizing device should be resiliently elastic, one roller being harder than the other. Typically, a steel roller cooperates with a rubber roller. The surface of one roller may also be coated with a sponge rubber.

The apparatus of the invention may be used to perform the following finishing methods of textile material; the composition of the corresponding liquors is well known in the art:

Non-iron finishing
shrink-proof finishing
stiffening,
dyeing, particularly with pigments or reactive dyestuffs,
sizing, also of warp yarn layers,
softening,
hydrophobing
water drop proof finishing,
anti-fouling finishing,
soil-proof finishing,
oleophobing,
wrinkle-proof finishing,
lustering (chintz),
flame-proof finishing,
antistatic finishing,
felt-proof finishing,
anti-mite finishing,
decatizing,
effect finishing.

Liquors may be used which are aqueous, aqueous/organic or exclusively organic ones.

The foregoing description of preferred embodiments is not to be considered as limiting the invention or as to mention all possibilities, variants and modifications thereof.

What we claim is:

1. An apparatus for the continuous and controlled treatment of an absorptive and compressible material web, said apparatus comprising:

means for advancing the web along a path;

an applicator device for applying liquor to the web while the web is advancing along said path;

two solid surfaces on said path and downstream from said applicator device, said solid surfaces forming a nip for equalizing the distribution of liquor applied to the web by redistributing liquor from regions of the web which contain relatively high amounts of liquor to regions of the web which contain relatively low amounts of liquor, without squeezing liquor out of the web; and thickness adjusting means for adjusting and controlling the thickness of said nip by moving one of said solid surfaces with respect to the other.

2. The apparatus of claim 1, further comprising: web unwinding means at one end of said path; web drying means on said path and downstream from said applicator device; and web rewinding means at another end of said path and downstream from said drying means.

3. The apparatus of claim 2, wherein said surfaces are formed by two rollers, one of said rollers being driven for rotation, one of said rollers being journalled for adjusting its distance from the other of said rollers.

4. The apparatus of claim 3, wherein one of said rollers is provided with heating means.

5. The apparatus of claim 3, wherein one of said rollers is provided with cooling means.

6. The apparatus of claim 2, wherein said surfaces are formed by inner opposing surfaces of two elongated shaped parts whose axes are parallel to each other and normal to said path, said path passing between said shaped parts, said opposing surfaces being tapered to approach each other along said path to form said nip, one of said shaped parts being movable with respect to the other of said shaped parts for adjusting the thickness of said nip, all of said opposing surfaces coming in contact with said web having a friction reducing layer.

7. The apparatus of claim 2, further comprising a liquid sensor mounted upstream from said nip for periodically scanning the width of the web, sensing the liquid condition of the web upstream from said nip, and generating a signal representative of the liquid condition of the web upstream from said nip, said thickness adjusting means being operatively connected to said sensor so that the thickness of said nip is controlled in response to said signal.

8. The apparatus of claim 2, wherein the thickness of said nip is adjustable between about zero and about the maximum thickness of the web upstream from said nip.

9. The apparatus of claim 2, further comprising means for determining the amount of liquor applied to the web by said applicator device.

10. The apparatus of claim 9, wherein said determining means comprises a first weight determining device upstream from said applicator device and a second weight determining device downstream from said applicator device, said weight determining devices being cooperable with each other to determine the amount of liquor applied to the web by said applicator device.

11. The apparatus of claim 2, further comprising rollers for spreading and expanding the web.

12. The apparatus of claim 2, further comprising a sensor for detecting tiny bulbs of liquor temporarily formed by said nip to determine the liquid condition of the web, said thickness adjusting means being operatively connected to said sensor for controlling the thickness of said nip in response to the liquid condition of the web.

* * * * *